US008833024B1

(12) United States Patent
Adams

(10) Patent No.: US 8,833,024 B1
(45) Date of Patent: Sep. 16, 2014

(54) SEAMLESS THREE DIMENSIONAL WALL PANEL SYSTEM

(71) Applicant: Joseph Adams, Godfrey, IL (US)

(72) Inventor: Joseph Adams, Godfrey, IL (US)

( * ) Notice: Subject to any disclaimer, the term of this patent is extended or adjusted under 35 U.S.C. 154(b) by 0 days.

(21) Appl. No.: 13/865,066

(22) Filed: Apr. 17, 2013

(51) Int. Cl.
*E04C 2/12* (2006.01)
*E04F 13/14* (2006.01)

(52) U.S. Cl.
CPC ..... *E04F 13/147* (2013.01)
USPC ..... 52/314; 52/315; 52/384

(58) Field of Classification Search
USPC ..... 52/314, 315, 311.1, 385, 384, 747.12, 52/287.1
See application file for complete search history.

(56) References Cited

U.S. PATENT DOCUMENTS 548,657 A * 10/1895 DeAngelis ..... 52/578
2,240,774 A * 5/1941 Harman ..... 52/388
3,304,673 A * 2/1967 Ramoneda ..... 52/220.3
5,885,032 A * 3/1999 Mallon et al. ..... 405/264
6,857,248 B2 * 2/2005 Ouellet et al. ..... 52/745.06

OTHER PUBLICATIONS

Lumberjocks.com, scrap wood wall, Nov. 2, 2011.*

* cited by examiner

*Primary Examiner* — Jeanette E Chapman
*Assistant Examiner* — Daniel Kenny
(74) *Attorney, Agent, or Firm* — Don W. Weber

(57) ABSTRACT

A unique, three-dimensional wall or ceiling panel system has finished panels with randomly placed blocks protruding from the base board of each panel. These blocks are arranged in horizontal rows. Each block has the same thickness to form uniform rows but the lengths and heights of each block vary to form a random pattern on the base board. The ends of several rows of each finished panel are left open. When the finished panels are laid end to end, these open spaces may be filled with connecting blocks to create a seamless effect for the wall or ceiling system. Outside or inside corners are also provided for continuing the system around corners. The corners have one beveled edge to create a 90 degree corner. The other end of the corner connects to the finished pieces in the usual construction manner.

5 Claims, 10 Drawing Sheets

SEAMLESS THREE DIMENSIONAL WALL PANEL SYSTEM

BACKGROUND OF THE INVENTION

This invention relates to the field of wall panels. In particular, a wall panel for covering a stud wall or a paneled wall is presented.

Much time and attention has been devoted in the building trades art to creating attractive and functional walls and ceilings. Walls and ceilings may be made of wood, drywall covered with plaster or walls covered with wallpaper or simply painted. Textured walls are provided with some types of plaster and textures may also be available with certain types of wallpaper. It is an object of this invention to provide a textured and decorative real wood wall or ceiling.

Post-industrial wood material may be salvaged from different types of wood use, for example from flooring applications. Much flooring must be custom cut to provide correct dimensions for a wooden floor. These cuts often leave scrap pieces of wood with the same thickness (the thickness of the floor) but of varying heights, due to the dimensions of the flat floor being created. The wood scraps are normally thrown away or burned. However, these scrap pieces may be cut into lengths of acceptable size, creating number of random discrete pieces having the same thickness, varying heights and any desired length and utilized in practicing the below described method of manufacture of a real wood wall or ceiling. It is an object of this invention to use post-industrial wood scrap to create novel and decorative wood ceilings or walls.

Other and further objects of this invention will become apparent upon reading the below described specification.

BRIEF DESCRIPTION OF THE PREFERRED EMBODIMENT OF THE INVENTION

Wall or ceiling panels are created from scrap wood having a set, standard thickness but randomly varying heights and lengths. The individual pieces are laid out in rows on a base board. All the rows have a uniform thickness from top to bottom because of the standard set thickness of the pieces. However, the height and lengths of the pieces varies randomly. The pieces are glued to the base board to form a decorative pattern.

Each base board has a number of gaps or voids at each end. Although each finished piece is different from each other finished piece, all of the finished pieces have identical left and right sides. The end of each finished piece has one or more gaps in one or more rows. When the finished pieces are laid side-by-side, the gaps align and abut each other. The finished panels may be screwed into place using the gaps. A connecting piece is then glued into the gap to cover the screws and to fill in the gap.

Special inside and outside corners and corresponding corner panels are also provided for continuing the wall or ceiling surface at corners of the room or ceiling.

The finished wall or ceiling has a seamless and textured, three-dimensional appearance.

BRIEF DESCRIPTION OF THE DRAWING FIGURES

FIG. 9 is a top exploded view of the outside corner.

DETAILED DESCRIPTION OF THE INVENTION

A seamless wall or ceiling panel system utilizes scrap wood pieces attached to a base board to produce a decorative wall panel façade that is easy to manufacture and install.

Figure 1:
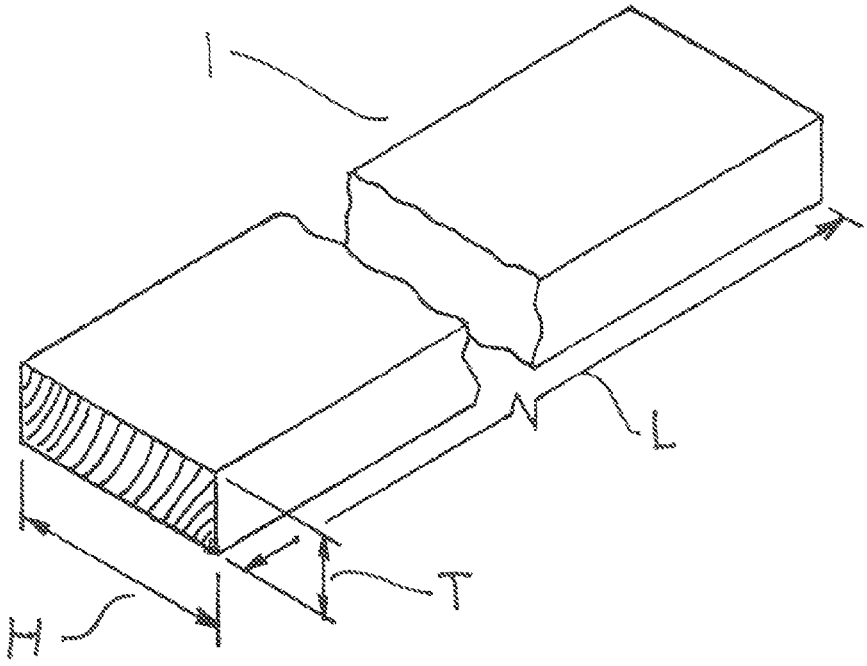
FIG. 1 is a perspective view of the basic building block of the invention.
Figure 4:
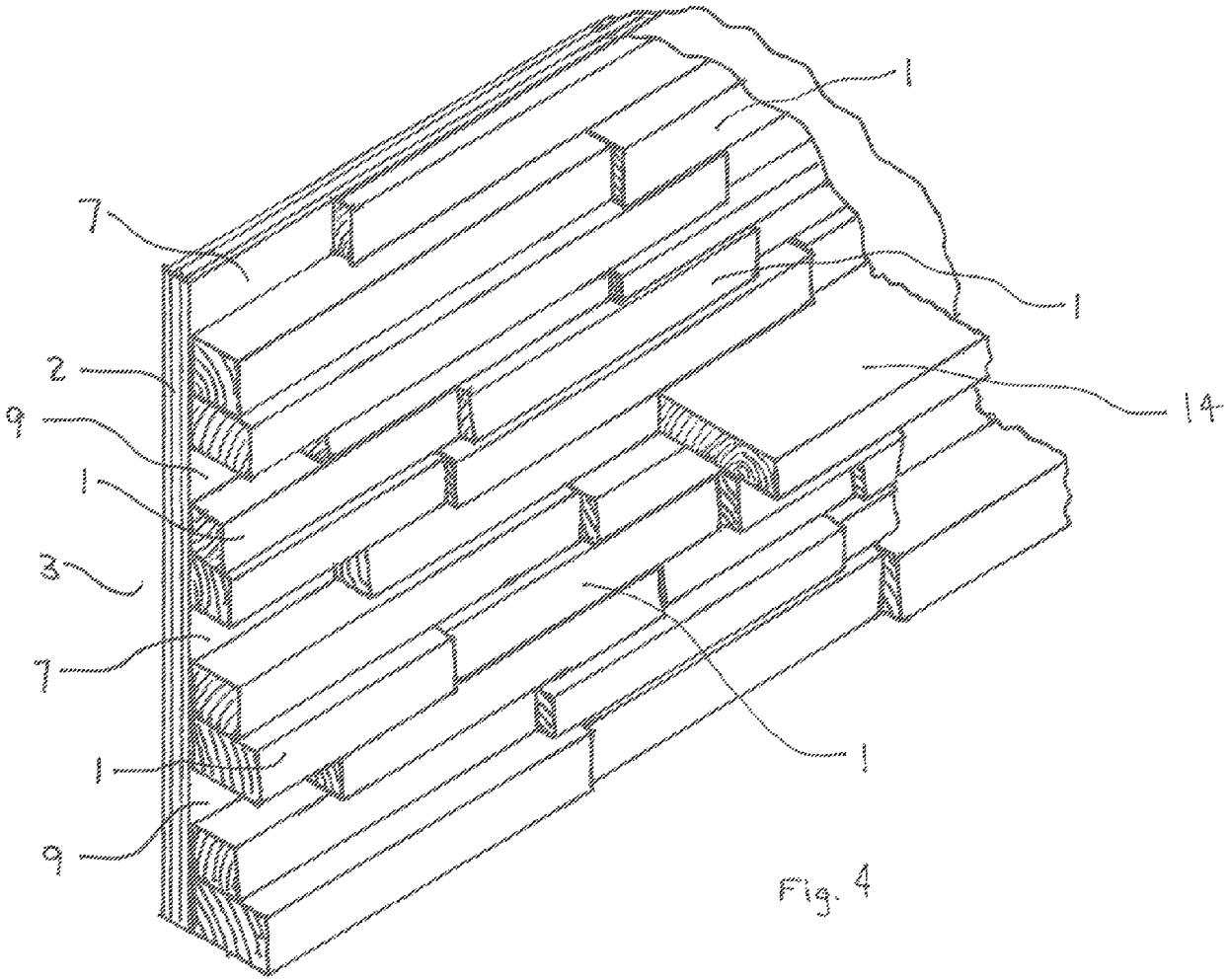
FIG. 4 is a partial cutaway perspective view of a single finished panel of the invention.
Figure 7:
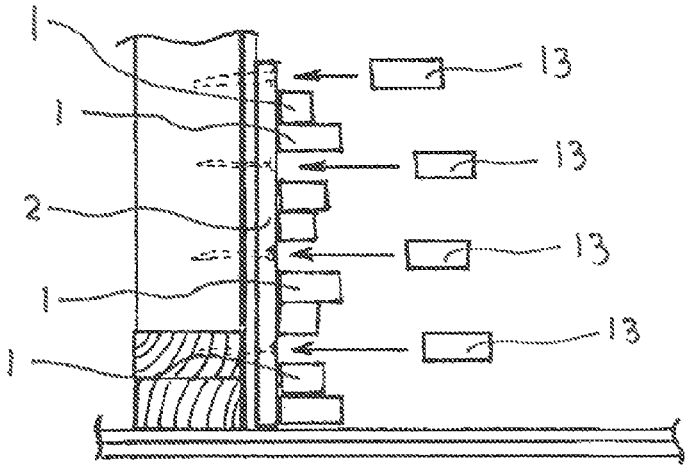
FIG. 7 is an end view of a panel showing its attachment to the wall and the insertion of the connecting pieces.

The wall panel system uses varied discrete varied pieces 1 best shown schematically in FIG. 1. These discrete varied pieces are essentially rectangular in shape as shown in FIG. 4. Stacked discrete pieces may be produced from scrap wood left over from the production of wood flooring. The wood flooring is usually 15/16ths inch in thickness. Therefore the stacked pieces have one dimension (thickness "T" on FIG. 1) that is 15/16 inch. 12 rows of 15/16ths inch pieces would be $12\times15/16^{th}$ inch=approximately 1 foot (actually 11¼ inches). In the preferred embodiment, the discrete pieces 1 all have a uniform thickness T.

The height "H" of the individual discrete pieces varies according to the remnants of the flooring cuts. The height H of the discrete varied pieces would vary from approximately ¾ths inches to 2½ inches in the preferred embodiment. However, the heights H could be of any dimensions, for example approximately ⅜ths inches to 1 and ⅜ths inches or ¾ths inches to 1 and ¾ths inches, etc. Each finished panel has discrete varied pieces with more than one height to create the decorative effect. The important feature of the heights of each discrete varied piece is that it is random and varied from one piece to another as will be explained later.

The lengths "L" of the discrete pieces also vary. The length of each piece is cut to standard lengths of 4, 8, 12 or 16 inches in the preferred embodiment for reasons to be explained later.

The discrete varied pieces shown typically in FIG. 1 has a standard thickness (15/16ths inch), random heights H (¾ths to 2½ inches), and set lengths L, 4, 8, 12, or 16 inches in length. As will be explained, the preferred embodiment uses pieces with the dimensions described above. However, other dimensions may also be used in practicing this invention as long as the thickness T is a multiple of the width W of the base board 2, and as long as the lengths L enable a worker to create pieces equal to the length of the base board, as will be explained later.

Figure 2:
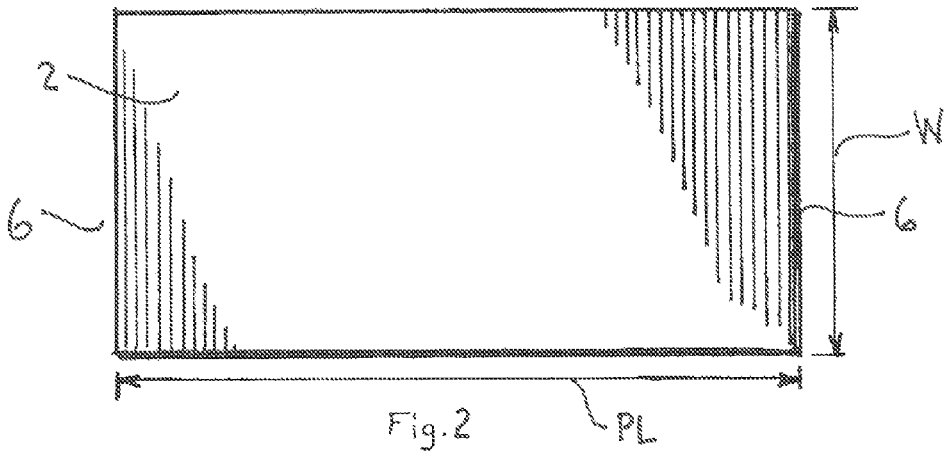
FIG. 2 is a plan view of the base of the invention.
Figure 3:
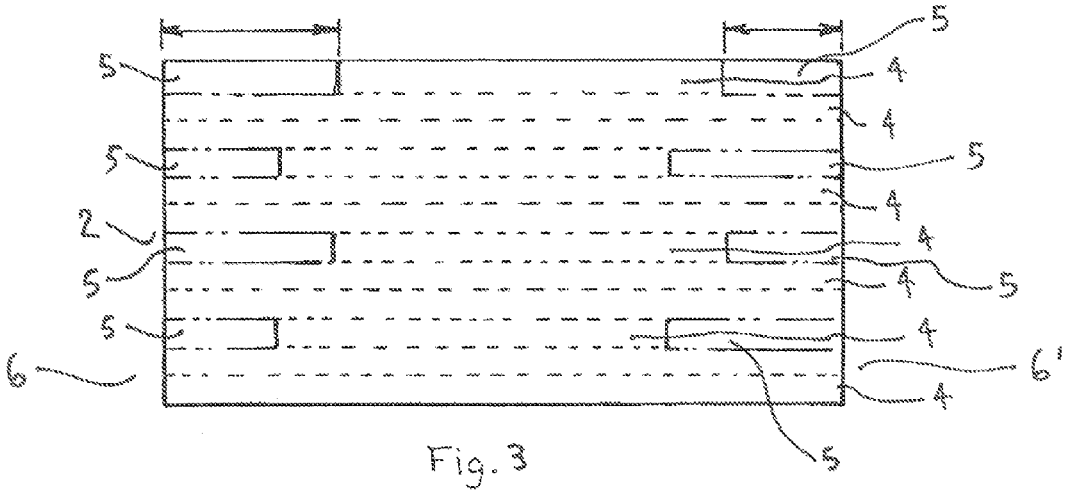
FIG. 3 is a plan view of the base board showing the rows in phantom lines and the connecting spaces at the ends of the invention.
Figure 6:
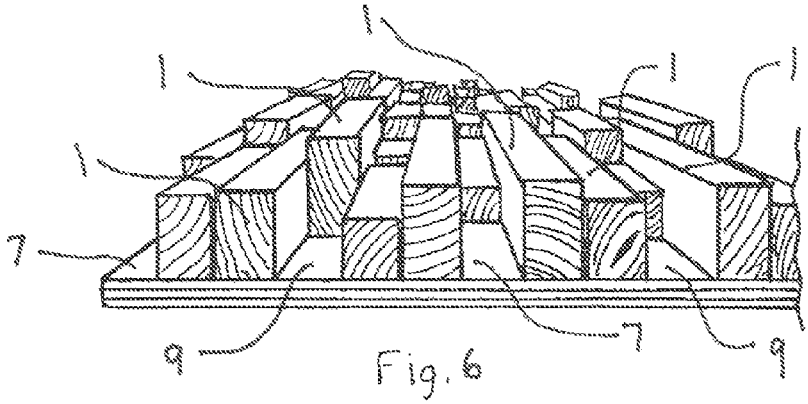
FIG. 6 is a side perspective view of one panel of the invention showing the general random layout of the varied pieces and the slots on the end of the panel.

Each base board panel 2 is essentially rectangular and flat and is approximately 1 foot wide (W on FIG. 2) and 4 feet long (PL on FIG. 2 represents Panel Length). The base board has an upper surface, a top, a bottom and left and right ends (toward the top, bottom and left and right sides of FIG. 2, respectively). The discrete varied pieces are attached to the upper surface (shown in FIG. 2) of the flat base board. The base of an individual finished panel 3, as best shown in FIGS. 4 and 6 is made of plywood. The base board 2 in one preferred embodiment is 1 foot in height and 4 foot in length with an approximately ¾ inches thickness, although the thickness of the base is unimportant. As shown in FIGS. 3 and 4, multiple discrete varied pieces 1 are glued to the 1 foot×4 foot base 2 in 12 rows from top to bottom of the 1 foot height of the base. The multiple discrete pieces 1 also have lengths that add up to 48 inches.

Assembly of a finished panel 3 results in 12 rows of discrete varied pieces having a standard thickness T laid side by side to create 48 inches of length. In the preferred embodiment the thickness dimension of each discrete varied piece is parallel to the upper flat surface of the base board. In manufacturing a finished, a worker selects random pieces having a standard thickness T but varied lengths L. It is easy for a worker to create random rows of discrete pieces with a total of 48 inches in length since the lengths are 4, 8, 12 and 16 inches. For example, two 16 inch pieces, one 8 and two 4s=48 inches; one 16, two 12s and two 4s also=48 inches; three 8s, one 12 and 3 three 4s=48 inches.

A plurality of rows at the left and right ends of each finished base board panel has connecting gaps 5. These connecting gaps 5 are used to attach each panel to the wall or ceiling with screws. Connecting pieces 13 are then inserted into the gaps of adjoining panels to connect the adjoining panels in the wall or ceiling system.

In rows with connecting gaps (rows 1, 4, 7 and 10 in the illustrated drawings) the total of the discrete varied pieces must be 48 inches minus the total of the gaps, 48-12 or 36 inches in the preferred embodiment shown and described herein.

It is to be appreciated that the dimensions shown above are for a preferred embodiment of the invention. However, other compatible dimensions may also be utilized in practicing this invention while still keeping within the spirit and disclosure herein. For example, a three foot square base board could be used to create the desired pattern as long as the standard rows 4 equal a multiple of 36 (for example, 48 rows with a thickness T of ¾ths inches) down the base and standard lengths equal a total of 36 along the base (one 12, two 8s and two 4s=36 inches). Many different dimensions for the discrete pieces 1 may be utilized in practicing this invention as long as the mathematical formula coincides with the dimensions of the base board 2.

Figure 5:
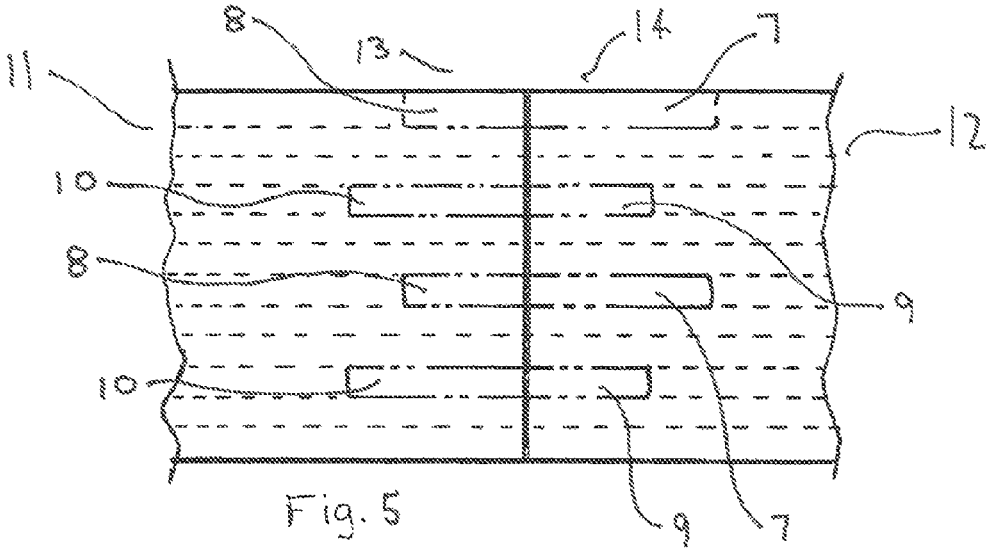
FIG. 5 is a plan view of two panels of the invention side-by-side showing the connecting pieces.

Multiple finished panels 3 may be combined to create a finished wall or ceiling. In order to accomplish this finished appearance, finished panels have connecting gaps 5 located at ends 6 (left) and 6; (right) of each panel. As best shown in FIG. 3, each panel has gaps or voids in gaps or voids in rows 1 and 7 and 4 and 10. However, the left side 6 of the panel has gaps 8 inches in length in rows 1 and 7 and gaps 4 inches in length in rows 4 and 10. On the right side 6' of each panel, rows 1 and 7 have gaps 4 inches in length and rows 4 and 10 have gaps 8 inches in length. When finished panels are laid side by side, as best shown in FIG. 5, the matching gaps in rows 1, 7, 4, and 10 equal 12 inches in length. Since the sum total of the length of the side-by-side gaps in rows 1, 7, 4, and 10 is 12 inches, a 12 inch connecting piece may be used to connect side-by-side mated panels as shown in FIG. 5.

As shown in FIG. 5, two mated finished panels may be laid side-by-side. A left panel 11 and a right panel 12 are laid side-by-side. In one preferred embodiment, the right side 13 of the left panel 11 is next to the left side 14 of right panel 12. Connecting gaps 5 are left open in rows 1 and 7 (from the top in FIG. 5) and rows 4 and 10 (from the top in FIG. 5) on both mated panels 11 and 12 as shown. The left end 13 of panel 11 abuts the right end 14 of panel 12. When two panels are put together, the left end gaps align with the right end gaps.

Panel 12 gaps 7 in rows 1 and 7 are aligned with corresponding gaps 8 in panel 11, rows 1 and 7. Similarly panel 12 gaps 9 in rows 4 and 10 are aligned with corresponding gaps 10 in panel 11, rows 4 and 10, as shown. All aligned gaps in rows 1, 4, 7 and 10 are 12 inches in length, since all aligned gaps are either 4+8 or 8+4=12 inches. Since all gaps in Rows 1, 4, 7 and 10 are 12 inches, a standard 12 inch connecting piece 13 may be used to connect the side-by-side panels. Other panels may be laid side-by-side in a similar manner to create the complete wall or ceiling. Connecting these gaps as described above creates a virtually seamless wall or ceiling.

The 4 and 8 inch gaps shown and described herein are meant as an illustration only and not as a limitation on this invention. Other gap lengths may be utilized in practicing this invention. For example, all gaps (7, 8, 9 and 10) may be 6 inches in length. When laid side-by-side they would still equal 12 inches (6+6) and could still use a standard 12 inch connecting piece 13. Or gaps 7 and 10 could be 7 inches while corresponding gaps 8 and 9 could be 5 inches (7+5=12). Any number of variations of gap lengths could be used. There is also no requirement that the corresponding gap lengths be uniform (12 inches). Some could be 9 inches and others 6 inches, for example. However the preferred embodiment is as shown and described as it is easier and more efficient to manufacture panels and ceilings and walls on a mass basis using uniform dimensions as described.

The gaps are also used to secure the panel to the wall with wood screws before the connecting pieces are glued into the panel. Having 12 inch gaps in certain rows allows the panel to be fastened to the studs.

Another aspect of this invention is the decorative effect created by using discrete varied pieces of random heights h as shown and described above. Since the height of the discrete pieces is random, a multi-layered panel is produced, as bets shown in FIGS. 4 and 6. The panel has a seamless effect since the random adjacent pieces have varying heights at the seams or edges of the adjacent panels.

As best shown in FIG. 4, some discrete varied pieces may be specially manufactured at shelf heights H. These special shelf pieces 14 could be, for example, 10 or 12 inches. These enlarged pieces can be used to create a shelf effect on the panel.

Special inside or outside 15 corners may also be provided. A number of stacked outside corners 15 are shown in place on an outside corner of a wall in FIG. 8. (An outside corner means the edges of the wall meet and a corner is placed over the edge. An inside corner means the edges of the wall meet at a closed end.) These corners are made to order for special applications having either inside or outside corners.

Figure 8:
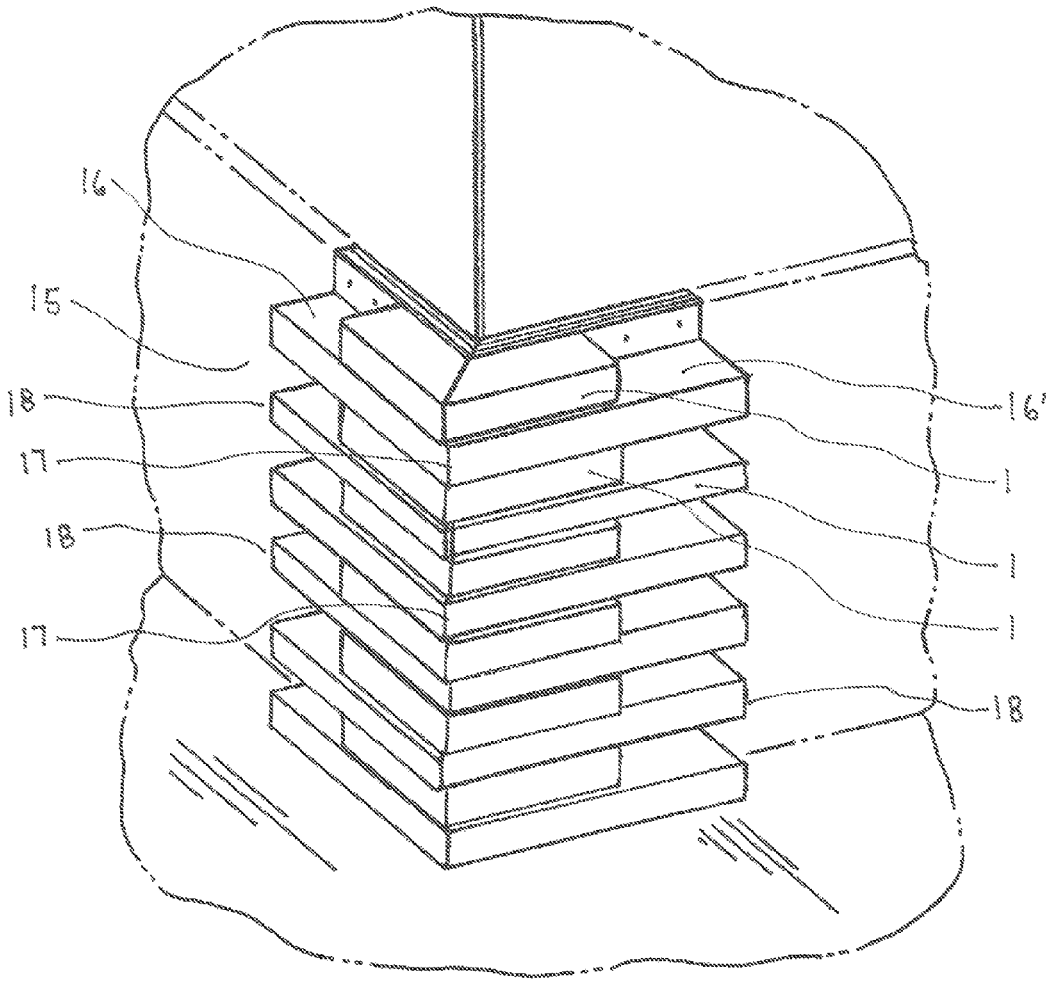
FIG. 8 is a perspective view of an outside corner of the invention and special corner panel.
Figure 6:
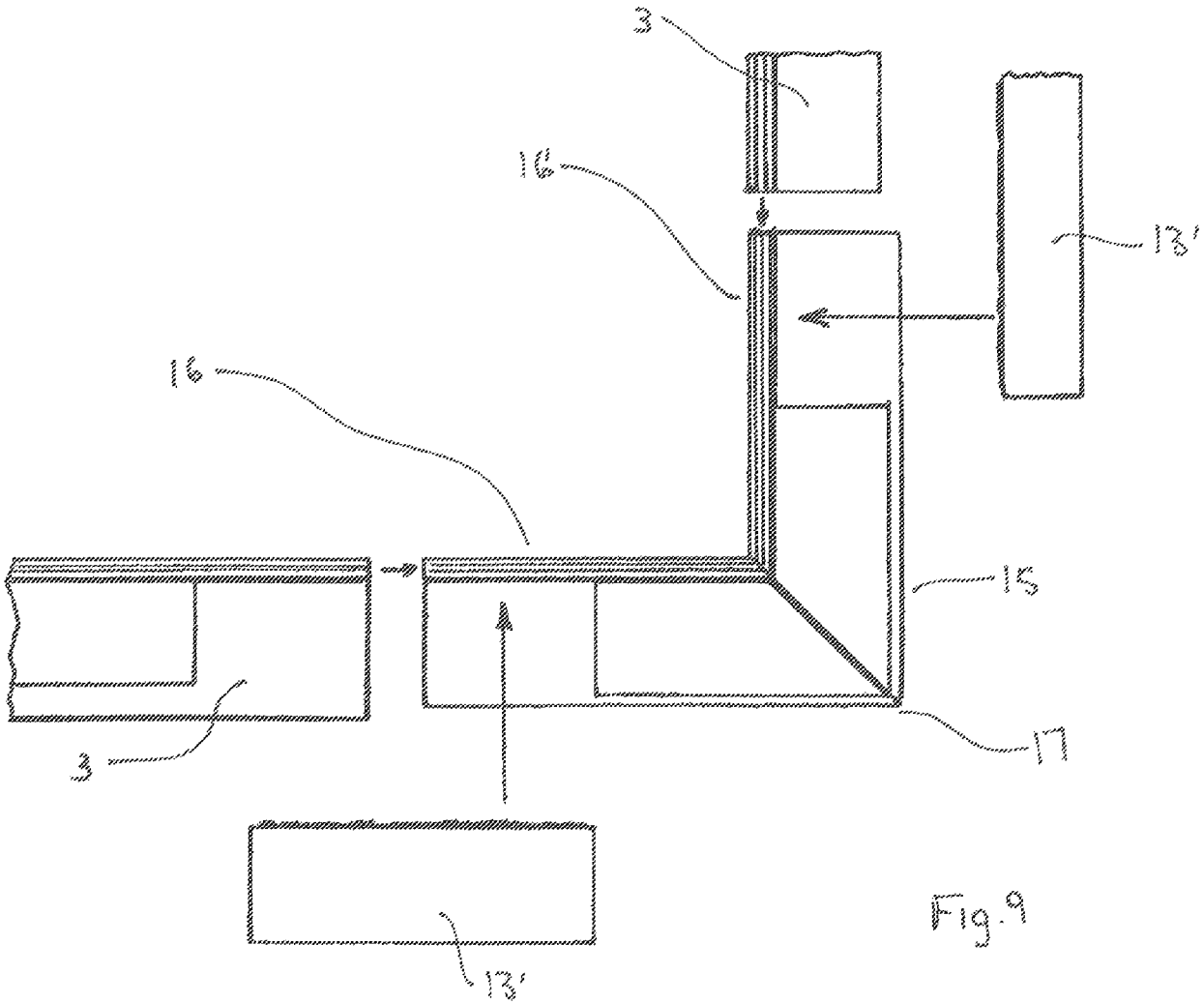

As shown in FIG. 8, an outside corner insert 15 has left 16 and right 16' perpendicular essentially rectangular legs that meet at an outside edge 17. The outer façade of each rectangular leg of the corner 15 has a variety of discrete varied pieces 1 as in the regular finished panel. The legs are attached to each other at a 90 degree angle at one end and each leg has an unattached end. The attached end of each leg is beveled at a 45 degree angle where the legs meet to form the straight edge 17 as shown. The far or unattached ends 18 of legs 16 and 16' are flat and are adapted to be mated and connected to a finished panel 3 as in the regular construction previously described. The corner piece 15 is approximately 11 and ½ inches wide and 24 inches in length.

Figure 10:
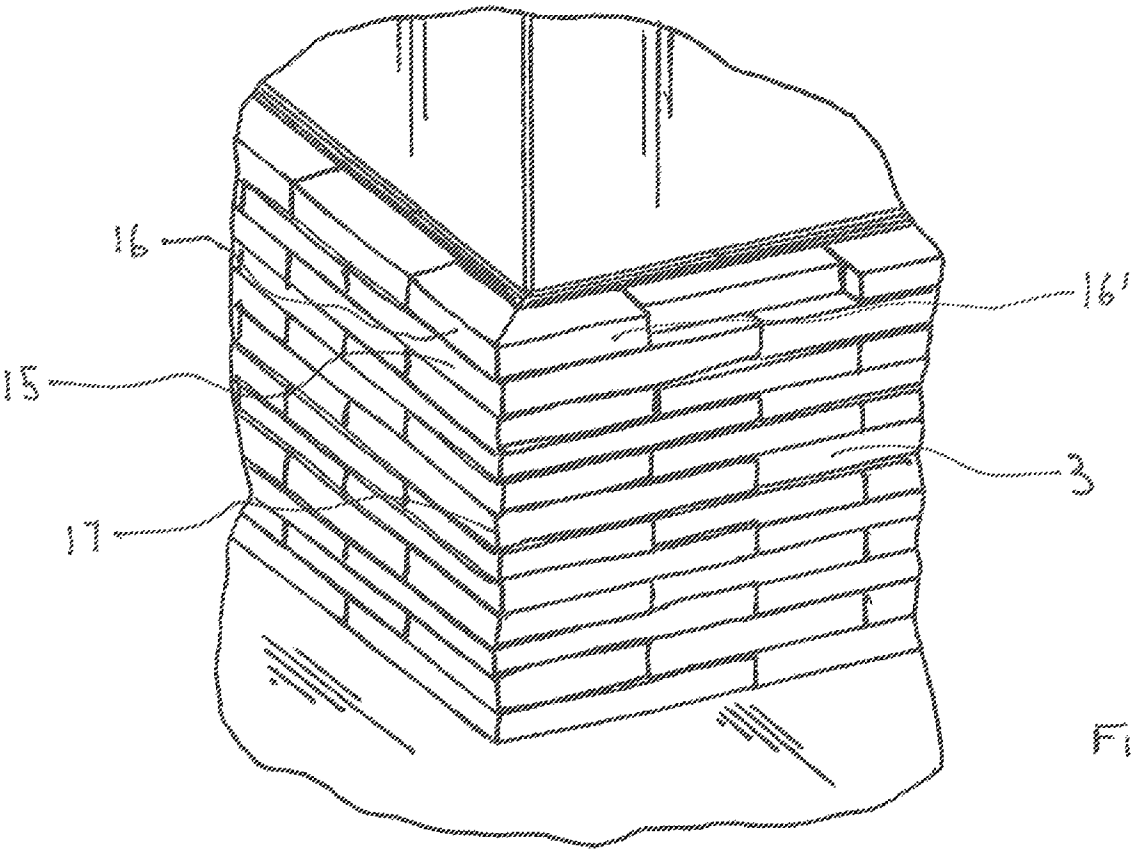
FIG. 10 is a perspective view of an outside corner showing the corner and other panels in place around an outside corner.

As shown in FIG. 9, the two legs 16 and 16' of the corner are beveled at a 45 degree angle so that they create a 90 degree angle to form a straight edge 17. The corner panel 15 wraps around a wall as shown in FIG. 10. Finished panels 3 are then affixed to the unattached end of each corner 15. The corner 15 and finished wall panel 3 are then connected using connecting pieces 13' as in the usual construction of the wall panel system. The corner 15 and finished panels 3 run across the wall to form the seamless system shown in FIG. 10.

Inside corners may also be provided. These inside corners are similar to the outside corners 15. En inside corner has a beveled edge where the two legs meet, but the inside corner is inserted into a corner of a wall rather than wrapping around the wall as is the case for an outside corner. Beveled inside and outside corners are well known in this field when applying crown molding to a ceiling or floor molding, although the three dimensional corners shown are unique as previously described.

Figures 11, 12:
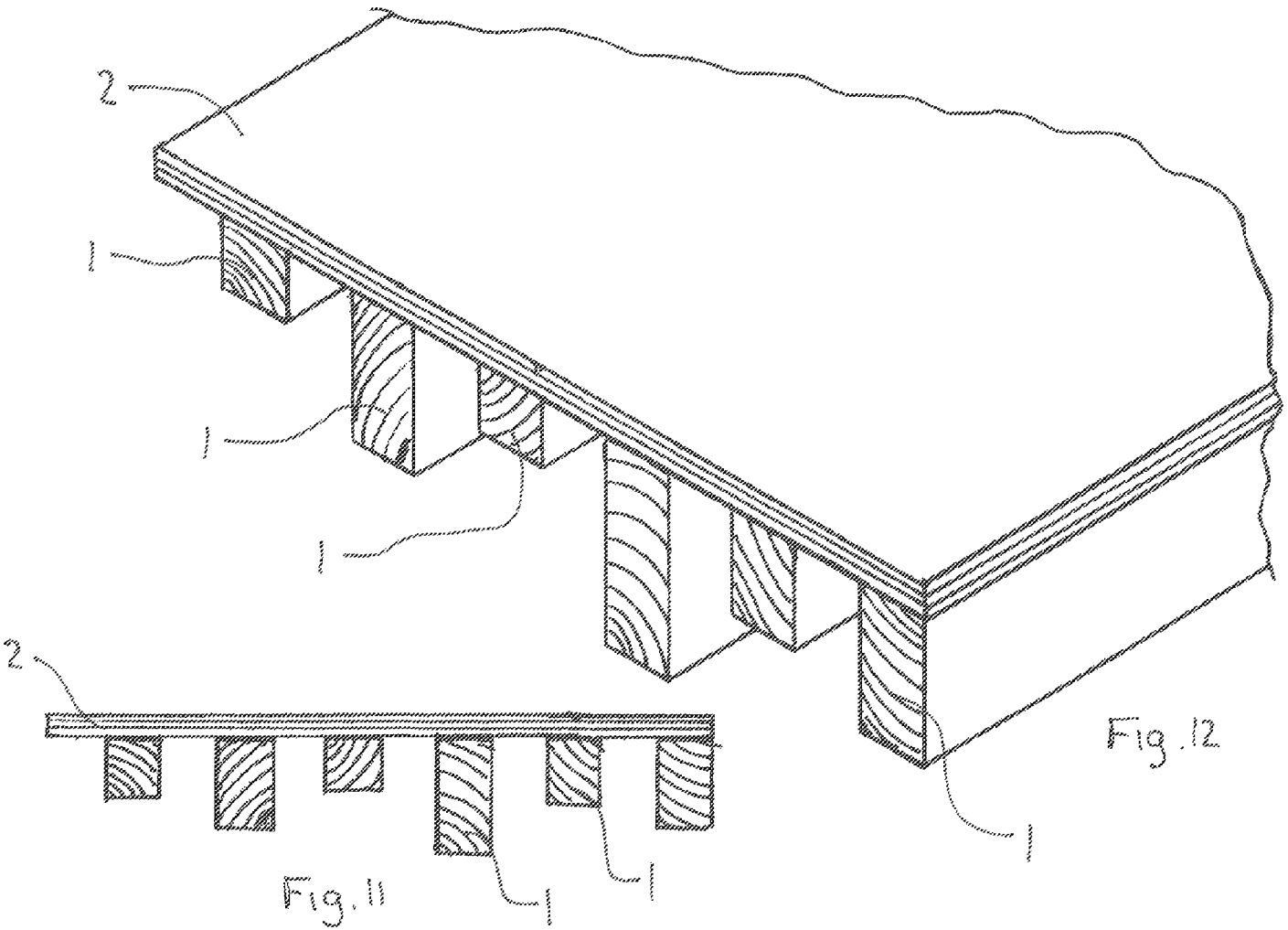
FIG. 11 is a side view of a ceiling panel showing some of the varied pieces and some of the intentional voids.
FIG. 12 is a perspective view of the ceiling panel shown in FIG. 11.

In order to reduce the weight of these panel systems, especially for ceiling applications, many discrete pieces may be removed from the design as shown, for example, in FIGS. 10 and 11. Removing rows of discrete pieces reduces the weight of the panel while still keeping the decorative effect thereof. In one embodiment, every other row (alternate rows) may be removed, several of the multiple rows, or discrete pieces may be left from the design to create holes or voids in the overall pattern. The placement and attachment of discrete pieces at the discretion of the worker or designer is within the spirit and disclosure of this invention.

Figure 13:
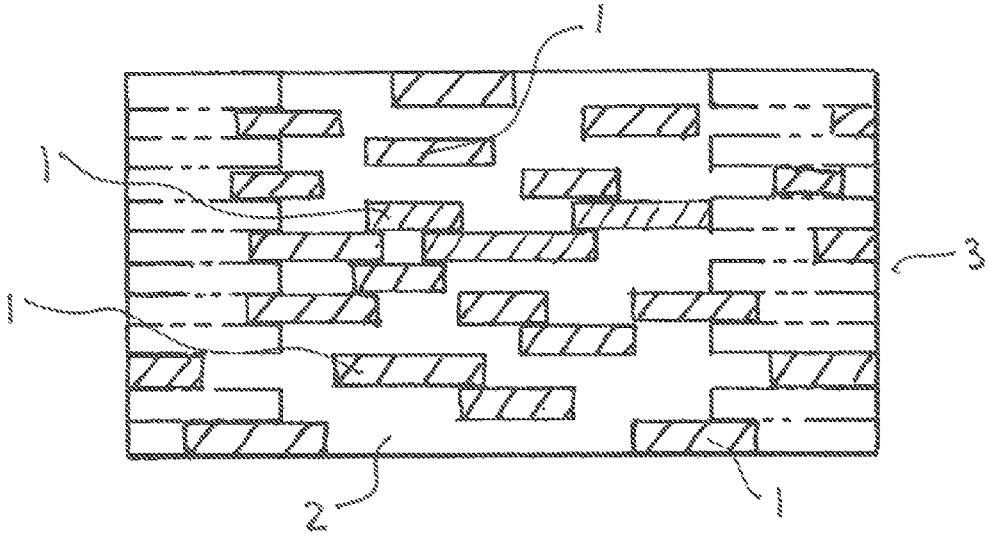
FIG. 13 is a top view of one variation of a panel showing an open pattern of blocks.

FIG. 13 shows one such lightweight embodiment of the invention. These finished panels 3 have only a few discrete varied pieces 1 attached to the base board 2 as shown.

Figure 14:
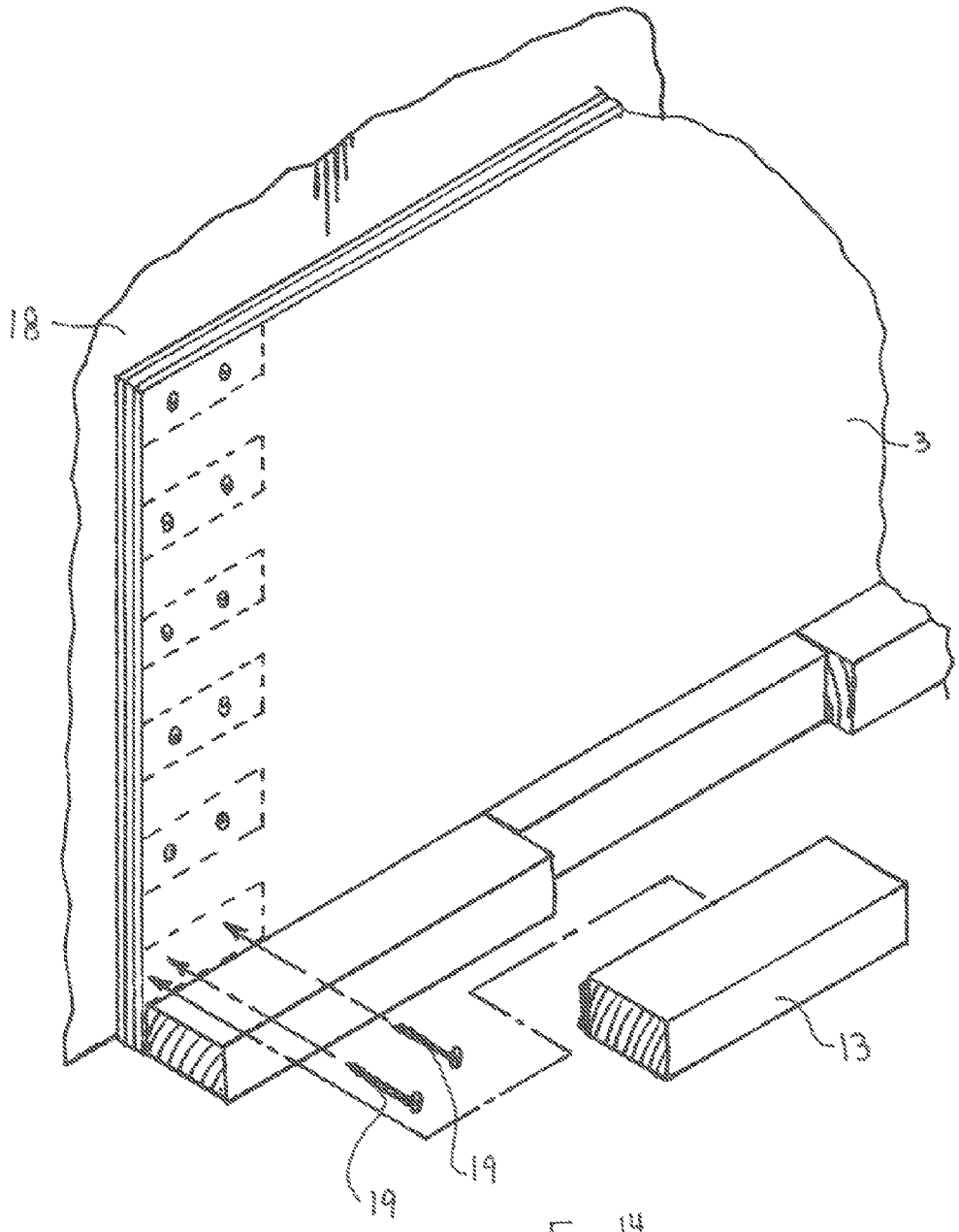
FIG. 14 is a perspective view of a panel as it is attached to a wall.

As shown in FIG. 14, the panels 3 are attached to a wall 18 or ceiling with screws 19. A connecting piece 13 is then glued or otherwise attached to the wall 18 and the screws 19 are covered up for a more finished appearance.

Normally, in the preferred embodiment, four different thicknesses of discrete pieces are used to create the decorative effect. However, to further reduce weight and cost, the base board itself may be used as a lower level. Adding three other thicknesses of discrete varied pieces to the base board creates a suitable four level effect.

The manufacturing process of these panels utilizes scrap wood and is simple and economical. A worker takes the flat base board and either sets it on a table, work station or special jig. The worker then randomly attaches a plurality of discrete varied pieces by any convenient method such as gluing. The worker makes sure that the thicknesses are parallel to the flat surface of the base board in rows, creating uniform rows from top to bottom. However, the worker is careful to select pieces with different and varied heights and lengths to form a decorative pattern on the finished piece. Gaps are left at the left and right ends of each base board in the finished panel so that the finished panels can be screwed into the wall or ceiling. Connecting pieces are also supplied so that the finished system can cover the gaps if desired.

Having fully described my device, I claim:

1. A panel system for a wall or ceiling, comprising:

(a) a plurality of flat base boards, each base board having an upper surface, a top, a bottom and left and right ends wherein each base board has a width W and a length PL;

(b) a plurality of varied, discrete essentially rectangular pieces, each piece having a uniform thickness T but varying lengths L and heights H, wherein the total of lengths L of said plurality of discrete pieces equals PL, wherein said discrete pieces are randomly attached to said base boards in a plurality of full rows from top to bottom, and wherein at least two of said discreet pieces in each row have different lengths L, and wherein the thickness dimension of said discrete varied pieces is parallel to the upper surface of said flat base boards;

(c) a plurality of gap rows at the left and right ends of said base boards each gap row having left and right connecting gaps for attaching said panel to a wall or ceiling wherein the sum of the lengths of the left and right connecting gaps in each row is equal to the length CL of a connecting piece and wherein the total lengths L of discreet pieces in said gap rows is equal to PL-CL, and wherein at least two of said discreet pieces in each gap row have different lengths, and wherein said gaps are adapted to receive connecting pieces;

(d) connecting pieces each having a length CL adapted to be inserted in the gaps of adjoining panels to connect adjoining panels in a wall or ceiling system;

wherein said plurality of base boards may be connected side-by-side by said connecting pieces to form a random and virtually seamless wall or ceiling.

2. A panel system for a wall or ceiling as in claim 1, wherein the discrete varied pieces are randomly attached only to alternate rows of said base boards.

3. A panel system for a wall or ceiling as in claim 1, wherein each base board is 24, 36 or 48 inches long and wherein the length of each discrete varied piece is 4, 8, 12 or 16 inches.

4. A corner insert for a wall or ceiling system, comprising a corner insert having left and right perpendicular legs attached at one end, the outer surface of each leg having a plurality of discrete random pieces attached thereto, wherein the attached end of each leg is beveled at a 45 degree angle to create a 90 degree edge and wherein the unattached end is adapted to be mated and connected to a finished panel as described in claim 1, having full rows and gap rows, wherein the gaps in each of said left and right perpendicular legs is adapted to be mated and connected to said finished panel.

5. A method of manufacturing a wall or ceiling system, comprising the steps of:

(a) setting a flat essentially rectangular base board having a length PL and a width W and an upper surface, a top, a bottom and left and right sides on a table or in a jig;

(b) randomly attaching a plurality of discrete varied pieces having the same thickness T but varying heights H and lengths L, to the upper surface of said base board in rows forming a plurality of full rows wherein the total lengths of random full row pieces equals PL, wherein at least two of said discreet pieces have different lengths and wherein the varied heights and lengths of said discrete varied pieces are randomly selected by a workman to form a random decorative pattern on said base board surface;

(c) randomly attaching a plurality of discrete varied pieces having the same thickness T but varying heights H and lengths L, to the upper surface of said base board in rows forming a plurality of gap rows wherein the total lengths of random gap row pieces equals PL-CL wherein CL is the length of a connecting piece and wherein at least two of said pieces have different lengths, and wherein the varied heights and lengths of said discrete varied pieces are randomly selected by a workman to form a random decorative pattern on said base board surface;

(d) (c) leaving gaps at the left and right ends of a plurality of gap rows for each base board for connecting said finished base board panels to each other wherein the total length of the left and right gaps in each gap row equals CL;

whereby a plurality of randomly manufactured panels having random full rows and random gap rows may be created to produce a decorative but random visual effect.

* * * * *